US011712589B2

(12) United States Patent
Springer

(10) Patent No.: US 11,712,589 B2
(45) Date of Patent: Aug. 1, 2023

(54) CONFORMAL FILTER

(71) Applicant: Immediate Response Technologies, LLC, Landover, MD (US)

(72) Inventor: Sean Springer, Crofton, MD (US)

(73) Assignee: Immediate Response Technologies, LLC, Landover, MD (US)

( * ) Notice: Subject to any disclaimer, the term of this patent is extended or adjusted under 35 U.S.C. 154(b) by 871 days.

(21) Appl. No.: 16/540,492

(22) Filed: Aug. 14, 2019

(65) Prior Publication Data

US 2020/0054902 A1 Feb. 20, 2020

Related U.S. Application Data

(60) Provisional application No. 62/718,501, filed on Aug. 14, 2018.

(51) Int. Cl.
*A62B 23/00* (2006.01)
*A62B 18/02* (2006.01)

(52) U.S. Cl.
CPC ..... *A62B 23/00* (2013.01); *A62B 18/02* (2013.01)

(58) Field of Classification Search
CPC . A62B 23/00–06; A62B 18/02; A62B 18/025; A62B 9/04; A62B 7/10; A62B 19/00–02
See application file for complete search history.

(56) References Cited

U.S. PATENT DOCUMENTS 2,199,230 A * 4/1940 Schwartz ..... A62B 23/02 55/DIG. 35
4,543,112 A * 9/1985 Ackley ..... B01D 53/0415 55/420
5,337,739 A * 8/1994 Lehman ..... B01D 46/10 128/205.27
2005/0160911 A1* 7/2005 Friday ..... B01D 39/2062 96/134
2006/0196157 A1* 9/2006 Greer ..... A62B 23/02 55/500

* cited by examiner

*Primary Examiner* — Valerie L Woodward
(74) *Attorney, Agent, or Firm* — Tanner IP, PLLC

(57) ABSTRACT

A filter housing for use with a protective mask or other personal protective equipment is described including a base, a top, a sidewall connecting the top and the base, and a void that houses a filter medium or a filter medium cannister. The housing also includes an inlet with an inlet opening for receiving ambient gas into the container, an outlet including an outlet opening for discharging gas from the container to the protective mask, and an interface for removably securing the filter housing to the protective mask or other personal protective equipment. The base may include a concave surface substantially surrounding the opening and the interface, and a space between the void and the concave surface of the base may be partitioned by a plurality of members connected at least partially to the base or the sidewall and define a substantially planar surface facing the void.

20 Claims, 10 Drawing Sheets

CONFORMAL FILTER

RELATED APPLICATIONS

This application claims the benefit of U.S. Provisional Application No. 62/718,501, filed Aug. 14, 2018, the contents of which are hereby incorporated by reference for all purposes.

BACKGROUND

The present disclosure relates generally to systems and methods for providing filters for filtering noxious or other undesirable agents, such as filters for respirator masks for chemical, biological, radiological and nuclear (CBRN) protection and filters for other filtering applications. There are generally two types of systems for providing breathable air to a user, those that clean ambient air, and those that provide their own gas. Among the ambient air systems, a filter or other decontamination unit may be provided, e.g. in the form of a canister, with a respirator apparatus to clean the ambient atmospheric gas and make it suitable for breathing. Such filter systems may or may not make use of auxiliary power.

Unpowered systems my typically include respirator masks, sometimes referred to as "gas masks", which are used extensively in chemical, biological, radiological and nuclear (CBRN) defense and other applications (e.g., other military, industrial or police applications) to protect a wearer against inhalation of noxious agents (e.g., chemical agents, biological agents, radiological agents, and/or other poisonous or otherwise harmful agents that can cause disease, injury or death). These masks may also provide protection for the wearer's eyes and/or skin.

In powered systems, ambient atmosphere may be drawn or pushed through a suitable filter/decontamination means, or other purifying means, by a powered fan or the like, such that the contaminated ambient air is rendered breathable. The purified resultant air is fed to a headpiece of some kind, such as a tight-fitting facemask. Such systems may be referred to as a Powered Air Purifying Respirator (PAPR).

Both powered and unpowered systems may typically use various types of filters, depending on the particular application, which are often encased in filter cannisters or housings that protect the filter medium, guide airflow through the filter, and/or allow for easy attachment, removal and replacement of filters.

SUMMARY

This summary is a high-level overview of various aspects of the disclosure and introduces some of the concepts that are further described in the Detailed Description section below. This summary is not intended to identify key or essential features of the claimed subject matter, nor is it intended to be used in isolation to determine the scope of the claimed subject matter.

According to various aspects of the invention, there is provided a filter housing for a respirator mask, PAPR, or other personal protective equipment. A filter housing may be configured for use with a protective mask or other personal protective equipment. The filter housing may include one or more of a base; a top; a sidewall connecting the top and the base; a void configured to house a filter medium and/or filter medium cannister; an inlet including an inlet opening for receiving ambient gas into the container; an outlet including an outlet opening for discharging gas from the container to the protective mask; and an interface for removably securing the filter housing to the protective mask or other personal protective equipment.

In embodiments, the base may include a concave surface substantially surrounding the opening and the interface.

In embodiments, a space between the void and the concave surface of the base may be partitioned by a plurality of members connected at least partially to the base and/or the sidewall and defining a substantially planar surface facing the void.

In embodiments, the interface may include a stem surrounding the outlet opening and at least partially enveloped by the concave surface.

In embodiments, the stem may include a distal face with a circumferential groove.

In embodiments, the circumferential groove may be configured to provide a double seal when the filter housing is joined to the protective mask or other personal protective equipment.

In embodiments, the circumferential groove has a depth of approximately 0.5 mm to 1.0 mm.

In embodiments, the groove may be recessed relative to a sealing face of the stem.

In embodiments, the sidewall may be substantially cylindrical.

In embodiments, the members may include a plurality of ribs that are formed integrally with the base.

In embodiments, the members may include a plurality of ribs extending outward from the outlet opening and a circumferential support wall having a similar shape to that of the sidewall.

In embodiments, the plurality of ribs may form a substantially flat platform for support of a filtering medium or a fines pad.

Embodiments may include an air-permeable fines pad that is configured to support a filtering medium and is fixed to the support wall.

In embodiments, the support wall may be constructed of a series of ribbed features.

In embodiments, the members may include a plurality of recesses and/or openings that allow gas to pass between channels defined by the members.

Embodiments may include a cannister containing the filtering medium, the cannister having a substantially planar bottom surface that is supported by the substantially planar surface defined by the plurality of members.

Additional embodiments may include methods of manufacturing filter housings as described above, and further herein. These and other aspects of the invention will now become apparent to those of ordinary skill in the art upon review of the following description of embodiments of the invention in conjunction with the accompanying drawings.

BRIEF DESCRIPTION OF THE DRAWINGS

A detailed description of embodiments of the invention is provided below, by way of example only, with reference to the accompanying drawings, in which.

Figure 1:
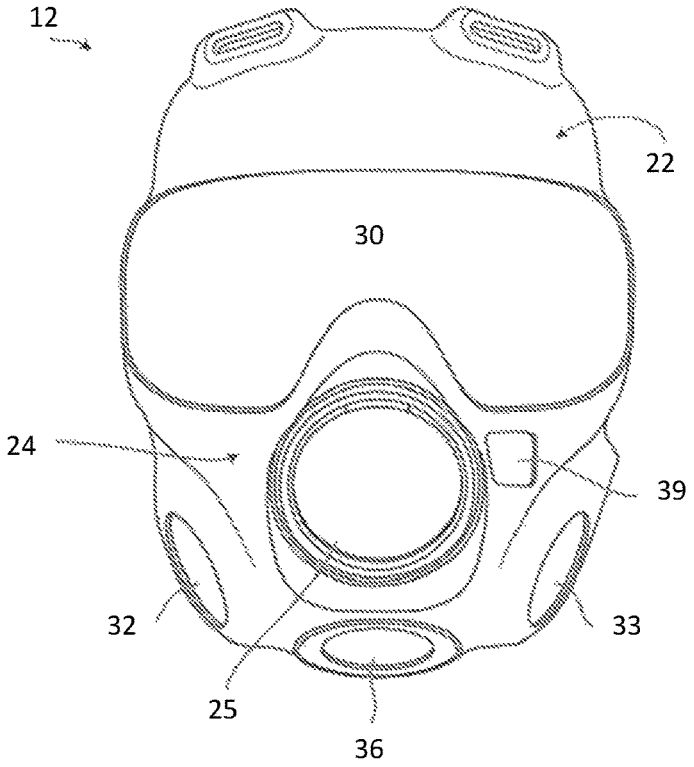
FIG. 1 (related art)
FIG. 1 shows a facepiece of an exemplary protective mask.

It is to be expressly understood that the description and drawings are only for the purpose of illustrating certain embodiments of the invention and are an aid for understanding. They are not intended to be a definition of the limits of the invention.

DETAILED DESCRIPTION OF EMBODIMENTS

It is understood that the invention is not limited to the particular methodology, protocols, etc., described herein, as these may vary as the skilled artisan will recognize. It is also to be understood that the terminology used herein is used for describing particular embodiments only, and is not intended to limit the scope of the invention. It also is to be noted that as used herein and in the appended claims, the singular forms "a," "an," and "the" include the plural reference unless the context clearly dictates otherwise. Thus, for example, a reference to "a filter" is a reference to one or more filters and equivalents thereof known to those skilled in the art.

Unless defined otherwise, all technical terms used herein have the same meanings as commonly understood by one of ordinary skill in the art to which the invention pertains. The embodiments of the invention and the various features and advantageous details thereof are explained more fully with reference to the non-limiting embodiments and examples that are described and/or illustrated in the accompanying drawings and detailed in the following description. It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law.

U.S. Pat. No. 7,331,364 describes a filter cannister having a concave profile for conforming the cannister to the curvature of the wearer's face, and a vibratory fill method by which filter material may be deposited in a cannister having a conformal base. According to the '364 patent, packing density in a conformal filter is optimized by vibrating the cannister with a higher horizontal amplitude, and is less dependent on vertical amplitude at the higher horizontal amplitude.

The present subject matter relates to systems and methods for providing conformal filters, which allow the "flat fill" of a conformal bottom housing. This can provide advantages over known techniques, such as but not limited to ease of manufacture and/or filling of the filter cannister, increased gas service life per unit volume of sorbent in the filter bed compared to other manufacturer's conformal shaped canisters, and decreased overall height of the filter.

FIG. 1 shows a related-art exemplary facepiece 12, which may be used in a protective mask. The facepiece 12 comprises a face-engaging seal that extends substantially around a perimeter of the wearer's face and includes a sealing surface 22 which creates a seal against the wearer's face.

The facepiece 12 also comprises a support portion 24 supporting components of the protective mask 10 (shown in FIG. 2) that are connected to the facepiece 12, including the lens 14, the breathing interface 16 connected to the filter 11, the speech transmitter 37, and the hydration interface 38. In this embodiment, the support portion 24 comprises a plurality of openings for accommodating components of the protective mask 10, including an opening 30 for the lens 14, openings 32, 33 for inhalation ports of the breathing interfaces 16, 17, an opening 34 for an exhalation port 35, an opening 36 for the speech transmitter 37, and an opening 39 for the hydration interface 38.

In this embodiment, the facepiece 12 comprises a polymeric material molded into a shape of at least part of the facepiece 12. More particularly, in this embodiment, the polymeric material is an elastomeric material. The elastomeric material may be any polymeric material with suitable elasticity. For instance, in various embodiments, the elastomeric material may be a thermoplastic elastomer (e.g., a fluorinated thermoplastic elastomer or any other thermoplastic elastomer) or a thermoset elastomer (e.g., a fluorinated thermoset elastomer or any other thermoset elastomer). In this example of implementation, the elastomeric material is a rubber material. More specifically, in this example, the rubber material is a butyl rubber. Any other suitable rubber compound may be used in other examples (e.g., natural rubber, butadiene rubber, styrene butadiene rubber, halogenated butyl rubber, etc.). In this example of implementation, the rubber material is molded into the shape of the facepiece 12 by an injection molding process.

The facepiece 12 may be made of any other suitable material and/or using any other suitable process in other embodiments. For example, in other embodiments, the elastomeric material may be another elastomer instead of rubber (e.g., a polyurethane elastomer, an ethylene elastomer, a propylene elastomer, a nitrile elastomer, an epichlorohydrin elastomer, a polychloroprene elastomer, an ethylene acrylic elastomer, a tetrafluoroethylene elastomer, a tetrafluoropropylene elastomer, a fluoroelastomer, a perfluoroelastomer, etc.). In yet other embodiments, the facepiece 12 may include a polymeric non-elastomeric material or any other suitable polymeric material (e.g., polyethylene, polyamide, polypropylene, polyvinyl chloride, chlorosulphonated polyethylene, chlorinated polyethylene, polyacrylate, polysulfide, silicone, fluorosilicone, etc.). As another example, in other embodiments, the facepiece 12 may be molded into shape by a compression molding process or any other suitable molding process.

The lens 14 may be shaped, constructed of any suitable materials, and/or otherwise configured in any other suitable manner in other embodiments (e.g. an aspheric design or any other suitable design, no recess, etc.).

The breathing interfaces 16, 17 are configured to allow the wearer to breathe safely, despite noxious agents that may be present in the wearer's environment, by connecting to the filter 11 or other source of breathable air. For example, rather than connecting to filter 11, the breathing interfaces 16, 17 may be connected to a breathing hose from a PAPR, etc. When not attached to a filter, or other source of breathable air, one or more valves in breathing interfaces 16, 17 may be automatically shut to prevent the wearer from inhaling contaminated ambient air or other gasses.

The filter 11 may include a filtering medium, which may enhance performance of the filter 11 and that of the protective mask 10, such as by providing enhanced filtration (e.g., against chemicals encountered in military or first responder applications, such as cyanogen chloride, hydrogen cyanide, dimethyl methylphosphonate, sulfur dioxide, and cyclohexane) and/or lower resistance to airflow (e.g. a lower pressure drop) and thus lower respiratory resistance for the wearer. Notably, the filtering medium may comprise active particles (e.g., activated carbon) that are derived from a polymeric precursor (e.g., polyvinylidene dichloride (PVDC)), impregnated with additives (e.g., metals and triethylenediamine (TEDA)), substantially uniform in size (e.g., monodispersed), and/or loose.

Figure 2:
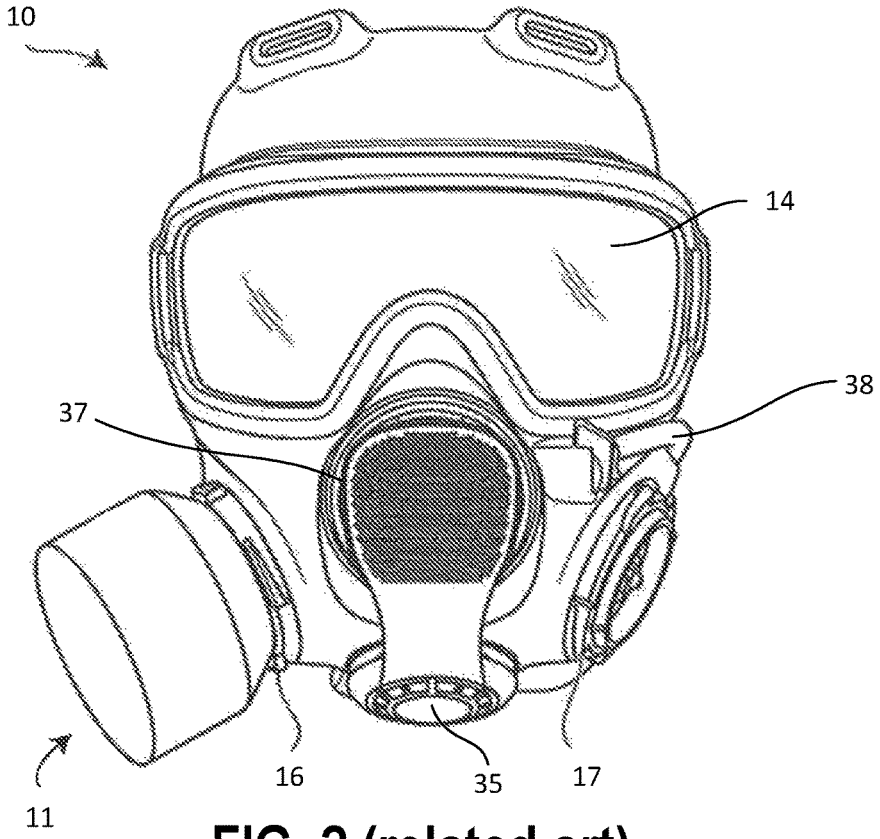
FIG. 2 (related art)
FIG. 2 shows an exemplary protective mask including the facepiece of FIG. 1 and several other components, including a filter for protecting the wearer against inhalation of noxious agents.

As can be seen in FIG. 2, the attachment of the filter 11 to the breathing interface 16 results in a relatively significant protrusion from the protective mask 10, which can be disadvantageous for a number of reasons, such as interfering with proper sighting of a firearm, presenting a snag hazard for personal equipment, straps, hoses, or external objects, etc.

Figure 3:
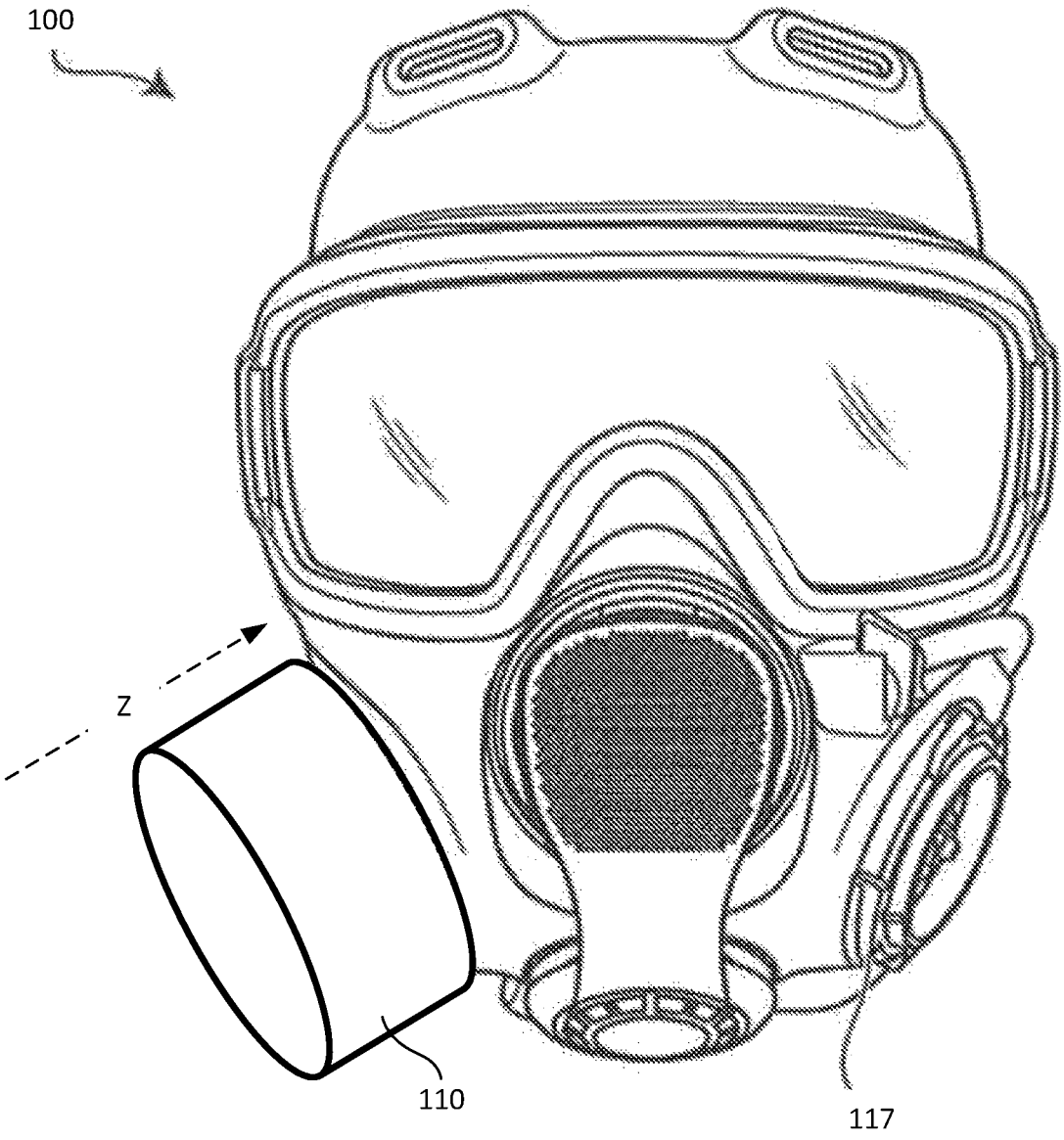
FIG. 3 shows an exemplary protective mask, including a facepiece similar to that shown in FIG. 1, with an attached conformal filter housing in accordance with an embodiment of the invention.

FIG. 3 shows an exemplary protective mask 100, including a facepiece similar to that shown in FIG. 1, a breathing interface 117, and an attached conformal filter 110 in accordance with an embodiment of the invention. As shown in FIG. 3, the conformal filter 110 is able to be mounted to the protective mask 100 such that it is closer to the protective mask 100 in the "Z" direction, and reducing the distance that the conformal filter 110 protrudes from the protective mask 100. Various means by which this can be achieved are described in further detail below.

Figure 4:
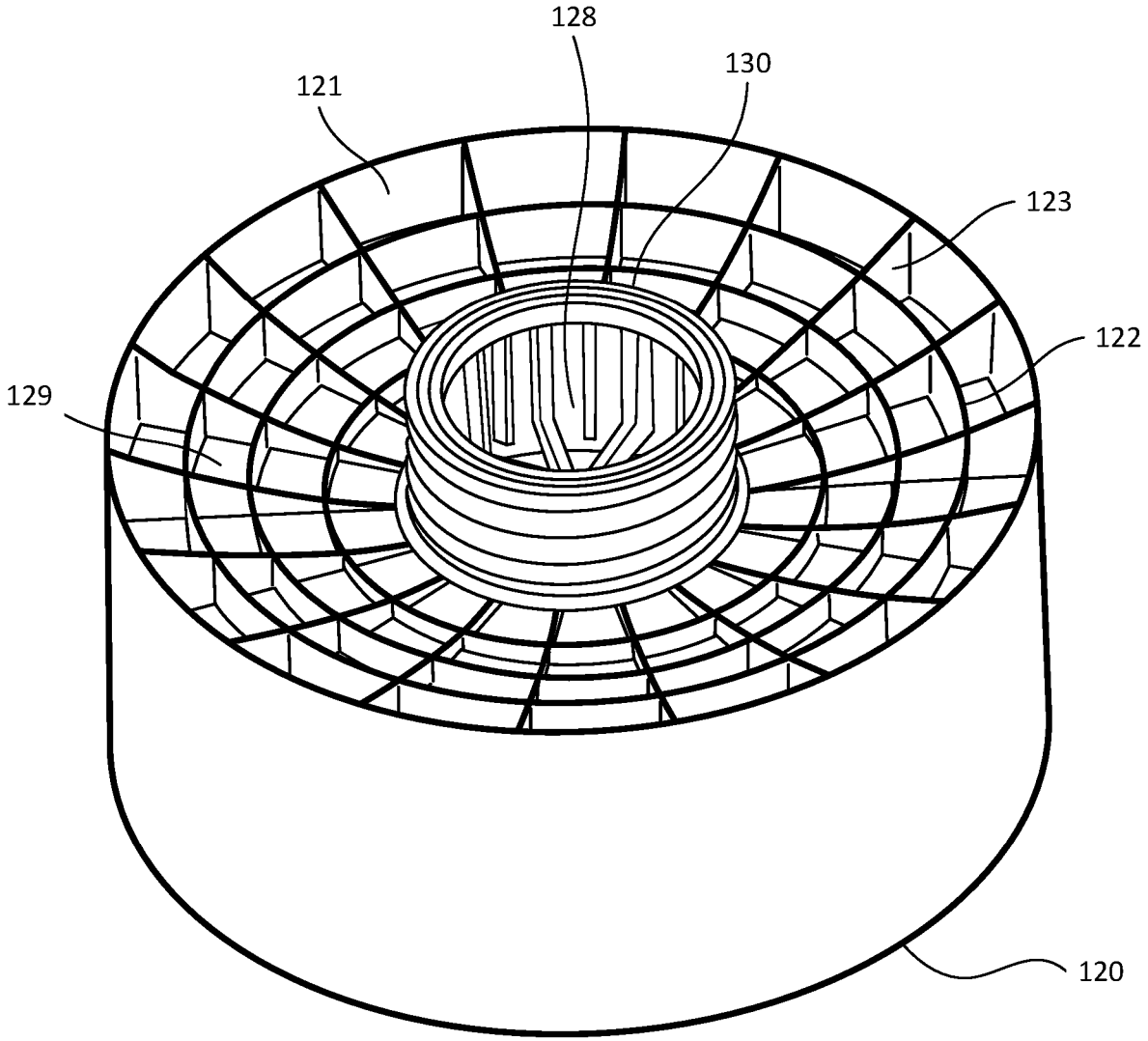
FIG. 4 shows an exemplary conformal filter housing according to certain aspects of the present disclosure.

FIG. 4 shows an exemplary conformal filter housing 120 according to certain aspects of the present disclosure. As shown in FIG. 4, the filter housing 120 may include a base formed by a plurality of exposed members 122 and ribs 123 that generally define a concave surface substantially surrounding an opening 128 through a mask (or other protective gear) interface 130.

Interface 130 (and other mask/protective gear interfaces discussed herein) may include a threaded connector by which filter housing 120 is securable to a filter mount (such as breathing interfaces 16, 17) by being screwed into the filter mount. The threaded filter interface may be a standard NATO threaded filter mount (e.g., with a 40-mm NATO thread). Any other suitable thread may be used in other examples.

Interface 130 may include a threadless connector which is securable to a filter mount (such as breathing interfaces 16, 17) without being screwed into the filter mount. By "threadless", it is meant that the filter housing does not have a thread required to retain the filter housing on the mask or other protective equipment. Rather, the filter may be a "quick-connect" filter. In some examples, the filter housing may be connectable to the filter mount by being pushed into the filter mount and subsequently secured thereto. To that end, the filter housing 120 may include a mounting structure or interface operable to engage with a connector of the filter mount with or without turning the filter housing.

In one example, interlocking elements of interface 130 and a filter mount may be positioned such that the interlocking elements of the filter mount do not interfere with an inward movement of the interface 130. The filter housing 120 may then be pushed inwardly towards the mask or other protective gear. After seating the interface 130 in the filter mount, which may include actuating an interface valve of the filter mount, the filter housing 120 may be turned such that the interlocking elements of the interface 130 and filter mount overlap and mesh together.

This turn of the filter housing 120 may be less than a complete rotation (i.e., less than) 360°, which makes for a quick connection, in contrast to a screwing action requiring multiple full rotations. For instance, in some embodiments, a turn of less than 180°, in some cases less than 120°, in some cases less than 90° may be used to secure the filter housing 120 to the filter mount (e.g., a one-eighth turn, a quarter turn, or a half-turn). An abutment of one or more of the interlocking elements may then stop the sliding motion of the interlocking elements. At that point, the filter housing 120 may be safely secured to the filter mount.

The filter housing 120 may include a surrounding sidewall 121 that defines a void (not shown) in which a filter medium may be held. Supported by the exposed members 122 and ribs 123 is a platform 129 that can be used to support filter medium within the void. In embodiments, the platform may be substantially flat, and may include an opening concentric with outlet 128.

The filter housing 120 may also include a top (not shown) with an inlet for drawing in ambient air or other gas. By providing a concave surface with the members 122 and ribs 123 facing the mask or other protective equipment, the filter housing 120 may be attached closer to the mounting surface, while still providing a flat fill surface on the opposite (not shown) side of platform 129.

Figure 5:
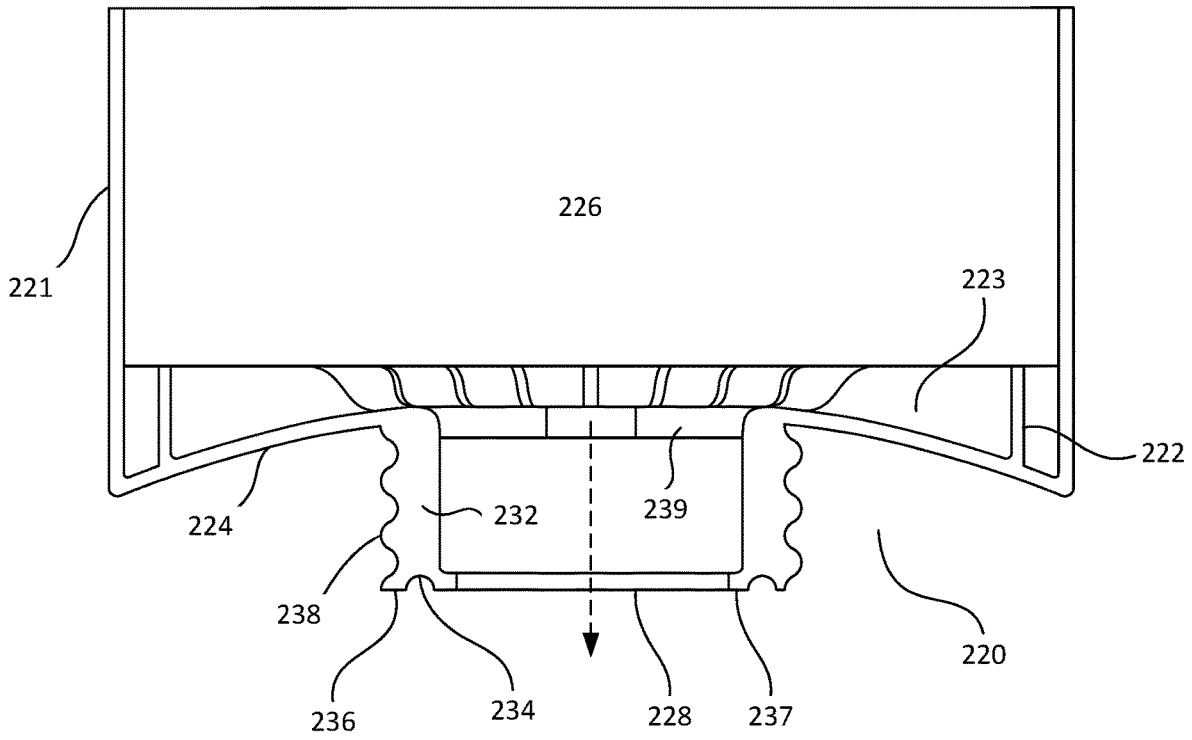
FIG. 5 is a cross-sectional view showings parts of another exemplary conformal filter housing according to certain aspects of the present disclosure.

FIG. 5 is a cross-sectional view showings parts of another exemplary conformal filter housing 220 according to certain aspects of the present disclosure. As shown in FIG. 5, conformal filter housing 220 may include a concave base 224 supporting a plurality of internal members 222 and ribs 223 that generally define a flat support platform facing void 226. The base 224 and ribs 223 may generally surround an opening 228 through a mask (or other protective gear) interface.

The interface (and other mask/protective gear interfaces discussed herein) may include a stem 232 with threads 238 by which filter housing 220 is securable to a filter mount (such as breathing interfaces 16, 17) by being screwed into the filter mount. The threaded filter interface may be a standard NATO threaded filter mount (e.g., with a 40-mm NATO thread). Any other suitable thread may be used in other examples. The interface may also include webs 239, which can be used, for example, to support a valve that prevents air from entering the filter housing 220 through the outlet 228.

The interface may include a substantially circular distal/mounting face including an annular outer seal 236, surrounding annular groove 224, surrounding annular inner seal 237, surrounding outlet 228.

The filter housing 220 may include a surrounding sidewall 221 that defines a void 226 in which a filter medium may be held. In some examples, a fines pad (not shown) may be supported by, and/or affixed to, the members 222 and/or ribs 223, thereby supporting filter medium within the void 226. In embodiments, the platform formed by members 222 and ribs 223 may be substantially flat, and may include an opening concentric with outlet 228.

The filter housing 220 may also include a top (not shown) with an inlet for drawing in ambient air or other gas. By providing a concave base 224 facing the mask or other protective equipment, the filter housing 220 may be attached closer to the mounting surface, while still providing a flat fill surface on the void-facing side of members 222 and ribs 223.

Figure 6:
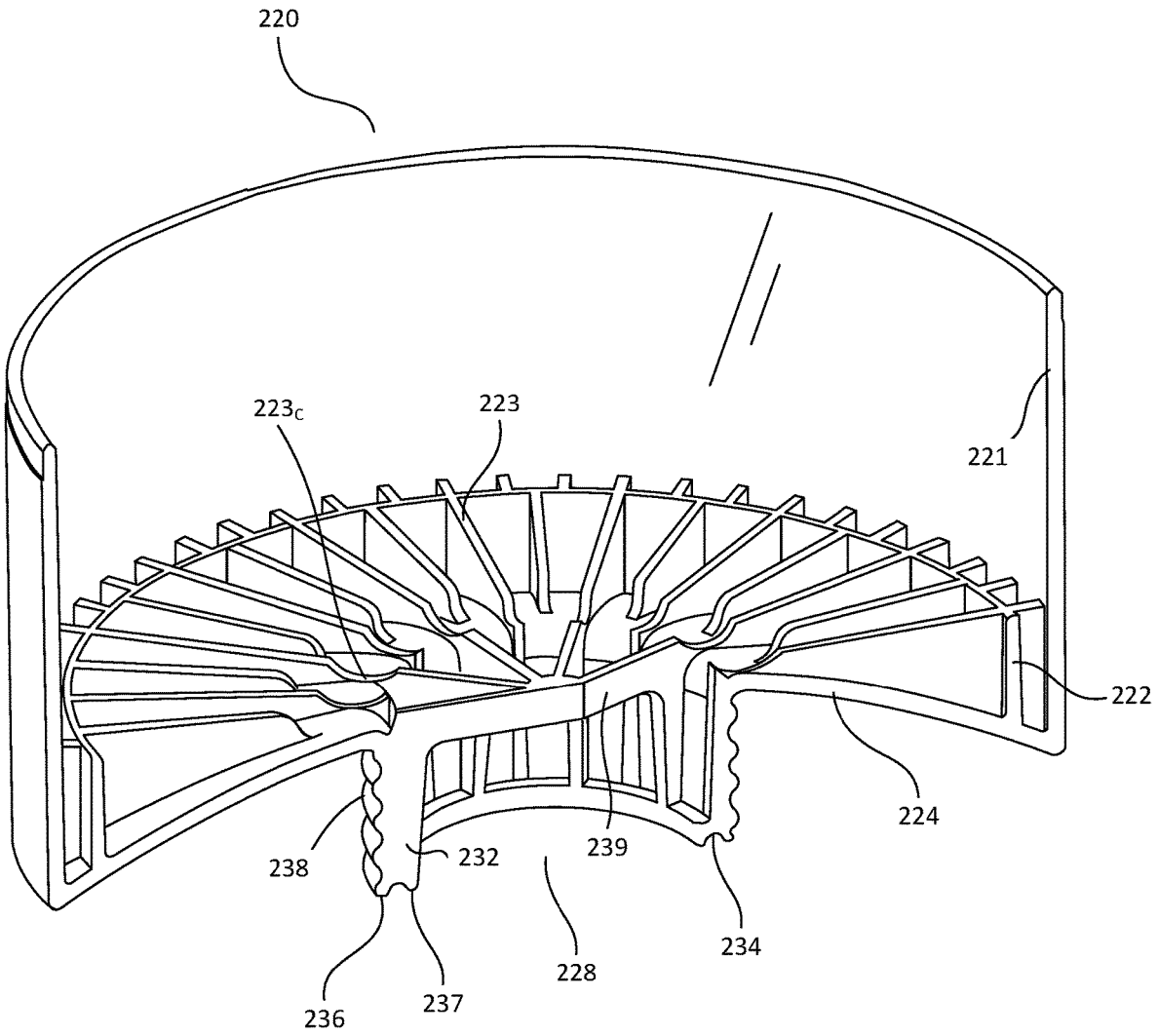
FIG. 6 is an isometric cross-sectional view showings parts of another exemplary conformal filter housing according to certain aspects of the present disclosure.

FIG. 6 is an isometric cross-sectional view showing additional details of the filter housing 220. It should also be noted that the filter housing 220 may include one or more valves (not shown) that prevent exhaled air from passing through the filter housing, such as a one-way valve positioned above or below webs 239.

As can be seen in FIG. 6, embodiments of the present subject matter can overcome challenges in keeping a continuous, conformal shaped outside of the canister profile (i.e. not making it ribbed), while having a platform available on the interior to weld or otherwise secure and support fines pad material within and around the perimeter, while also not creating too thick of a wall. In this case, a relatively thin sidewall 221 and member 222, along with ribs 223, can be used to meet these objectives. Normally, this platform might be envisioned as a solid feature around the perimeter of the housing, but the inventors have found that such configurations are less preferable due to, for example, moldability issues with plastic injection molding including sink marks that develop when attempting to mold thicker walls.

In embodiments, a fines pad may be ultrasonically welded to ribs 223, and/or the member 222 around the outer edge of the interior of the filter housing 220.

Ribs 223 also create the support structure for a flat bottom filter cannister, which can have preferable performance and/or manufacturing characteristics, while filling in the interior plenum of the conformal filter housing 220.

In embodiments, one or more of ribs 223 may have a cut in channel 223*c* to create a shared channel feature. These may allow, for example, the filter to have airflow between ribbed channels if there is blockage or insufficient airflow in any area of the filter. Such features can be advantageous in optimizing the percentage of the sorbent bed being used by not having dead flow channels if there is a blockage for any reason.

Figure 7:
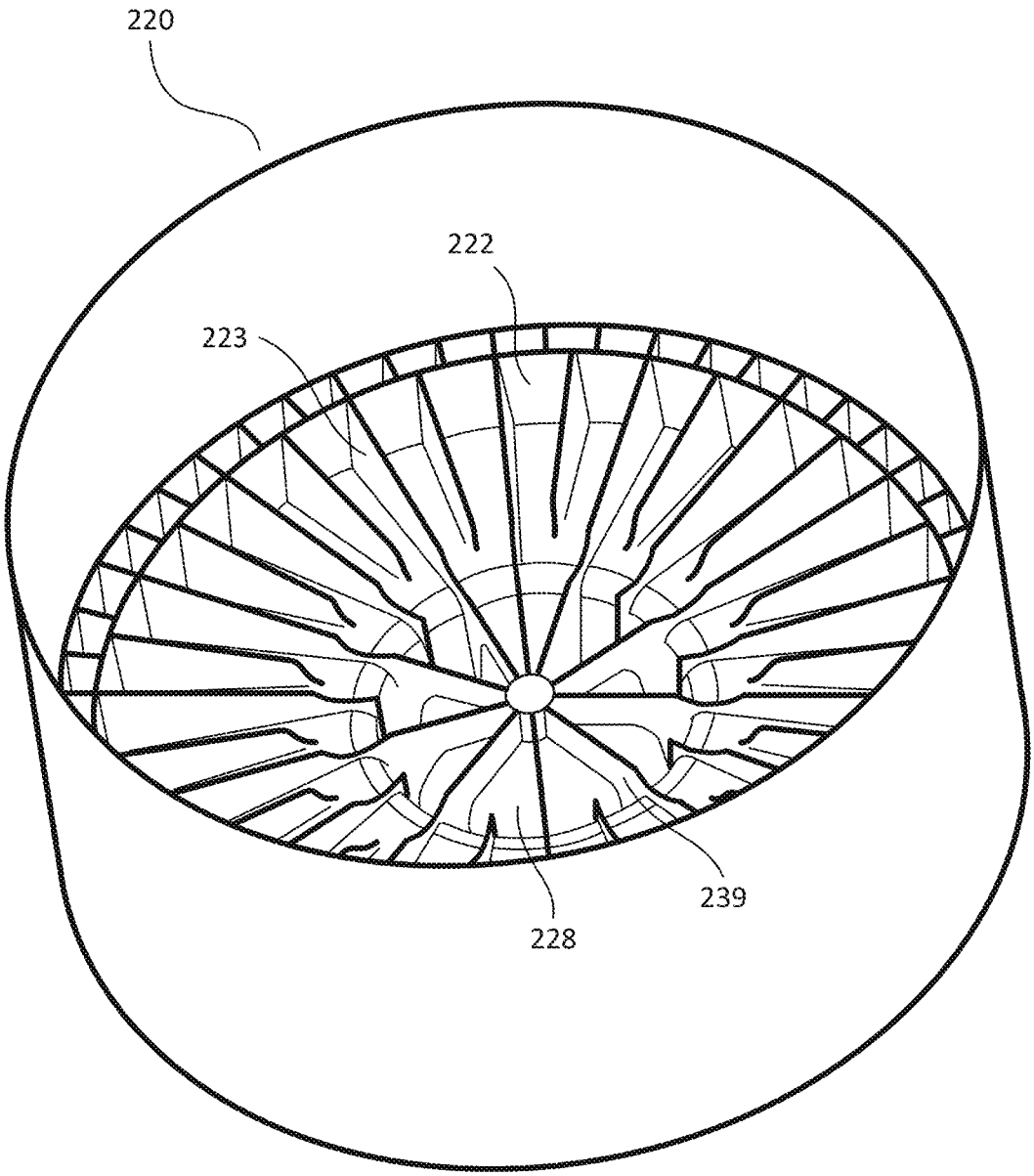
FIG. 7 is an isometric view of the exemplary conformal filter housing parts shown in FIG. 6.

FIG. 7 is an isometric view of the conformal filter housing 220 showing a top-down view of outlet opening 228, webs 239, ribs 223 and members 222. As can be seen in FIG. 7, in some examples webs 239 may be extensions of full or partial ribs 223. Ribs 223 may also provide channels through which inhaled air may be directed to outlet opening 228.

Figure 8:
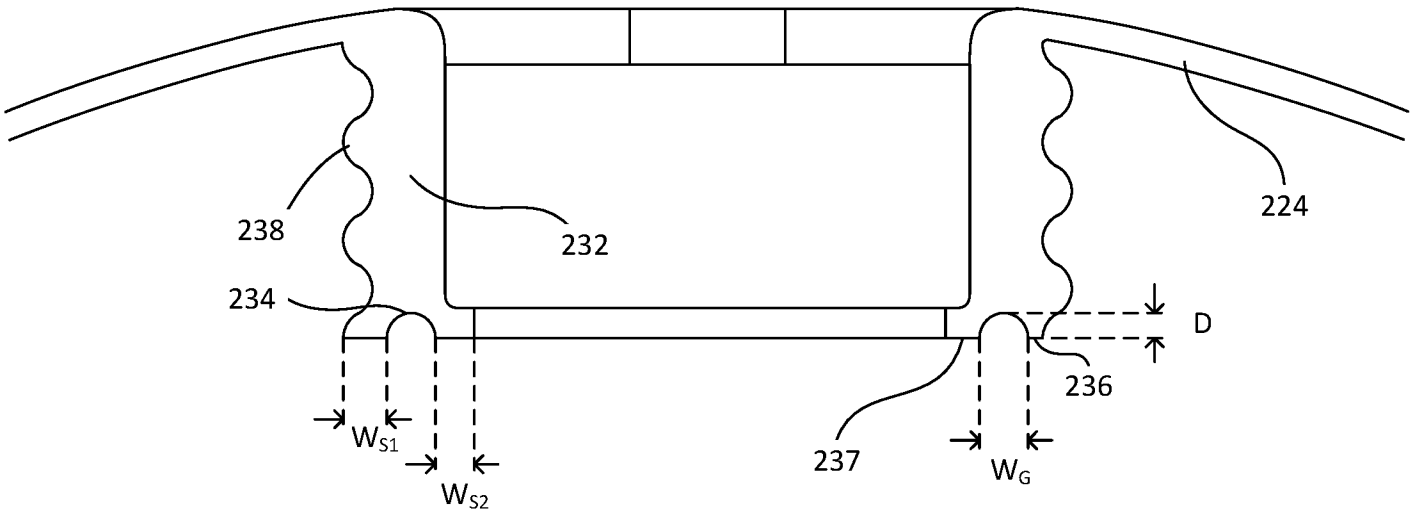
FIG. 8 is a cross-sectional view showing details of an exemplary filter housing stem with a circumferential groove.

FIG. 8 is a cross-sectional view showing details of an exemplary filter interface 230 including a stem 232 with a circumferential groove 234. As shown in FIG. 8, the filter interface 230 may include a substantially circular distal/mounting face including annular outer seal 236, surrounding annular groove 224, surrounding annular inner seal 237. The annular groove 224 may have a depth "D" e.g. approximately 0.5 mm to 1.0 mm, and may have a width "$W_G$" e.g. approximately 0.5 mm to 2.0 mm. By recessing the groove 224, the overall height of the filter when mounted to a protective mask or other equipment can be effectively reduced. Based on, for example, government specifications regarding the maximum height of the filter, and interface structure, this can provide benefits in maximizing the available space for filter material, reducing overall stem and/or filter height, etc. In this regard, the inventors found that the inward cut also creates a relatively low surface area, which allows a threaded sealing surface to effectively bite into a gasket, while not adding to the overall height of the product.

As also shown in FIG. 8, outer seal 236 may have a width "$W_{S1}$" e.g. approximately 0.5 mm to 3.0 mm, and inner seal 237 may have a width "$W_{S2}$" e.g. approximately 0.5 mm to 3.0 mm. The depicted configuration may be advantageous, for example, in providing a "double seal" around outlet 228, which can be more effective than a single seal as found in some conventional filters.

Figure 9:
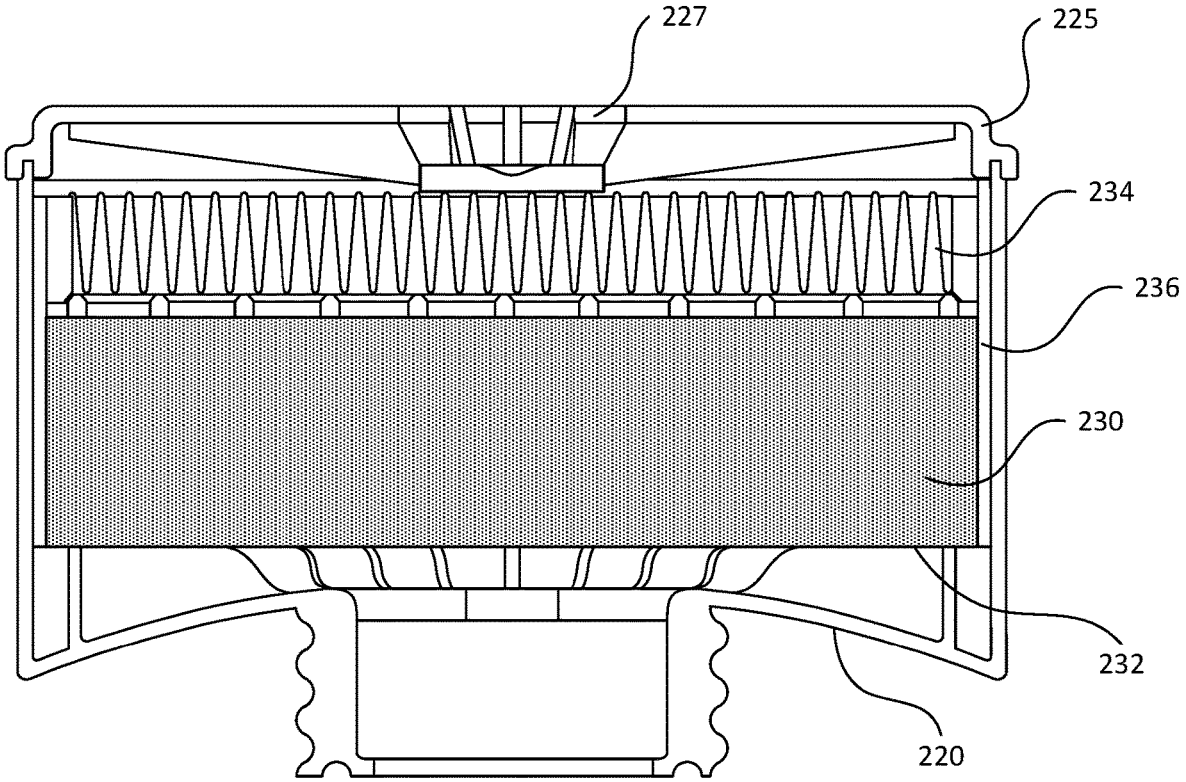
FIG. 9 is a cross-sectional view showing parts of an exemplary conformal filter according to certain aspects of the present disclosure.

FIG. 9 is a cross-sectional view showings parts of an exemplary conformal filter 210 including filter housing 220 according to certain aspects of the present disclosure. As shown in FIG. 9, the conformal filter 210 may include a fines pad 232, filter medium 230, a course filter 234, one or more of which may be held by a filter cannister 236. The conformal filter 210 may also include a top 225 with one or more inlets 227. In some example, the inlet 227 and/or outlet 228 may include a removable seal (not shown) that may be opened when the conformal filter 210 is used, which can preserve the shelf life and efficacy of the filter medium 230.

Figure 10:
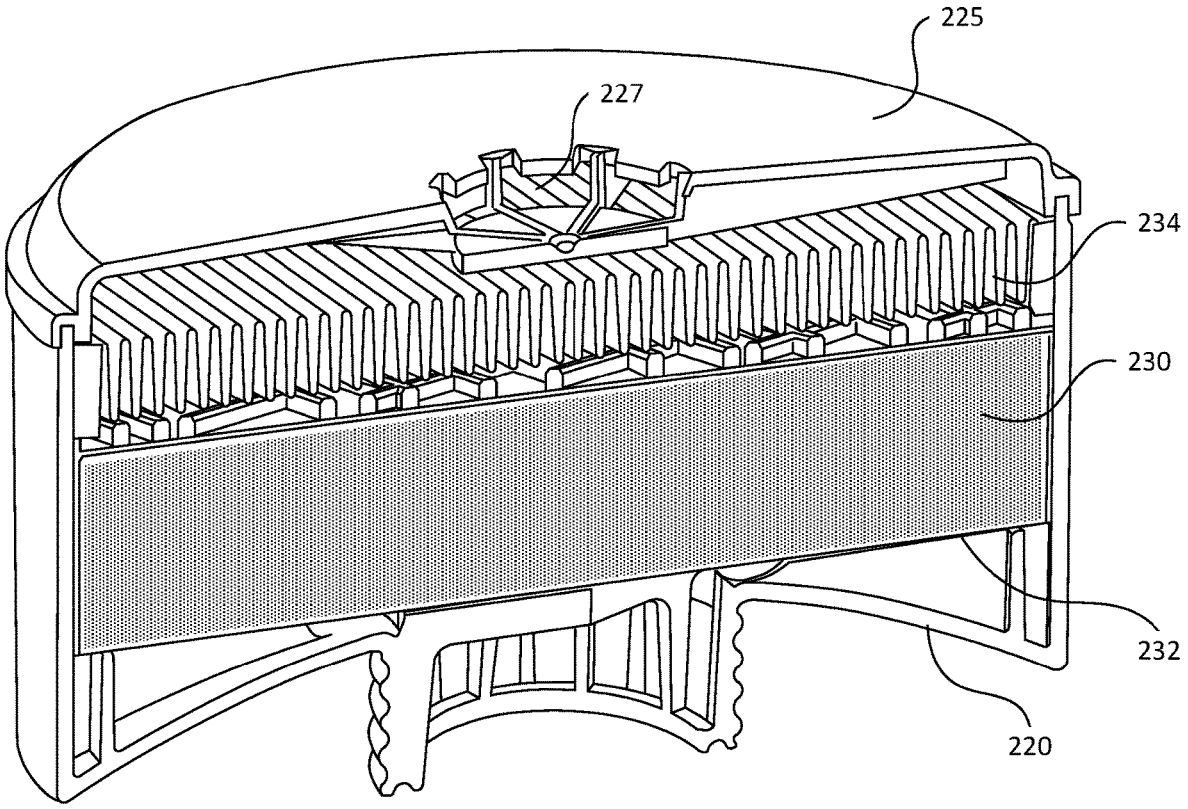
FIG. 10 is an isometric cross-sectional view showings parts of another exemplary conformal filter according to certain aspects of the present disclosure.

FIG. 10 is an isometric cross-sectional view showings additional details of the conformal filter 210 including fines pad 232, filter medium 230, course filter 234, and top 225 with inlets 227.

Figure 11:
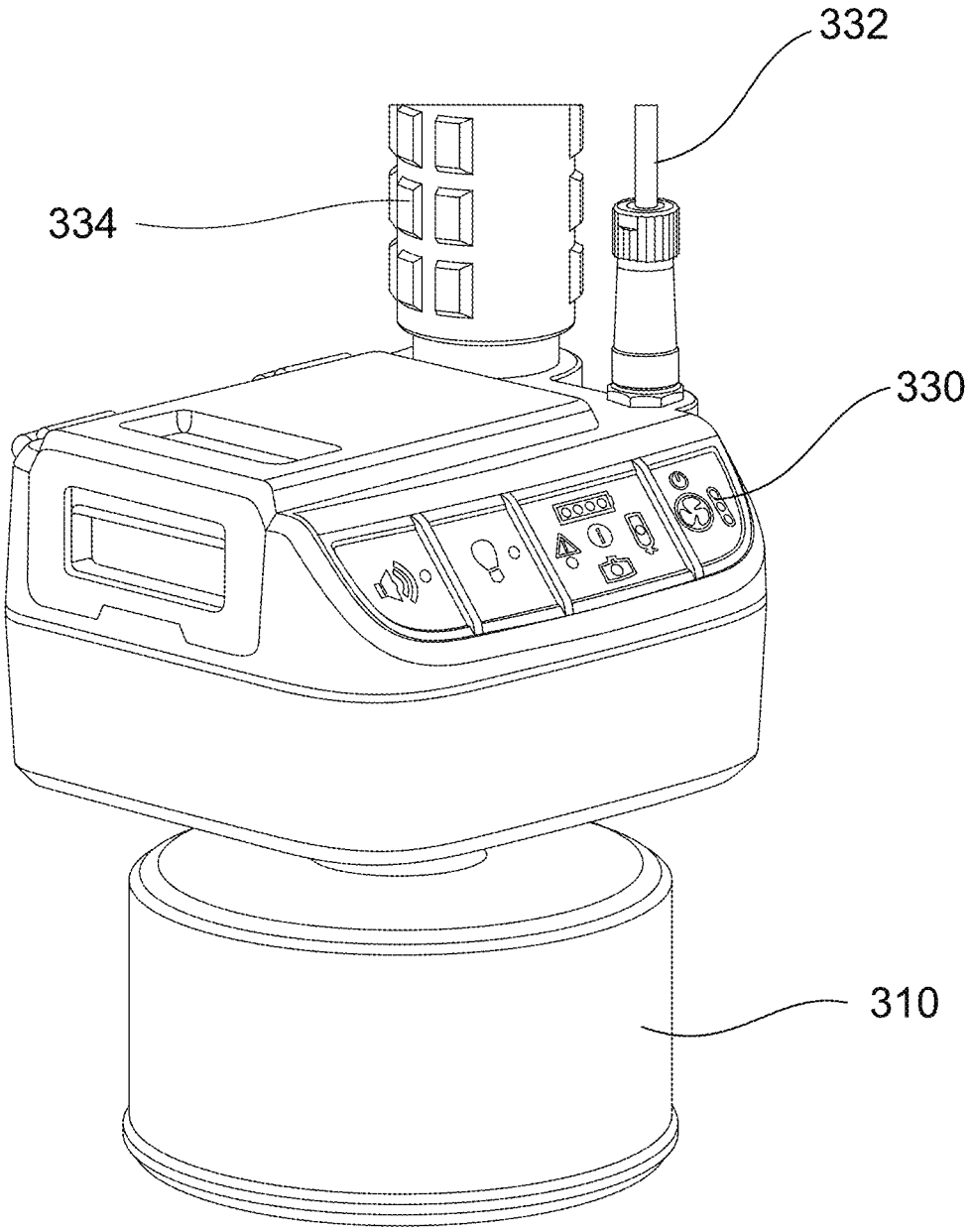
FIG. 11 is an isometric view of a PAPR including a filter that can be replaced by a conformal filter according to certain aspects of the present disclosure.

FIG. 11 is an isometric view of a PAPR 330 including a filter 310 that can be replaced by a conformal filter according to certain aspects of the present disclosure. Details of PAPR 330 are described in U.S. Application Ser. No. 62/586,393, entitled "MODULAR POWERED AIR PURIFYING RESPIRATOR SYSTEM," the contents of which are hereby incorporated by reference in their entirety. The PAPR 330 includes a non-ambient gas source line 332, and a breathing air tube 334, which can be connected to a protective mask as described herein. PAPR 330 also includes an ambient air inlet via filter 310. In embodiments, a conformal filter, such as conformal filter 210, may be configured to mount to the PAPR 330, effectively replacing filter 310. This can reduce the overall size of PAPR 330, or similar devices.

Aspects of filter units described herein may take various forms, and may include some features known in the art, and/or as described in U.S. application Ser. No. 15/624,670, entitled "FILTER FOR RESPIRATOR MASK OR OTHER FILTERING APPLICATIONS," the contents of which are hereby incorporated by reference in their entirety. Subject to the class of canisters fitted and the time spent in the contaminated area, the canisters may provide breathable air in a chemically, biologically or nuclear contaminated environment.

Unless explicitly stated otherwise, any feature of any embodiment discussed herein may be combined with any feature of any other embodiment discussed herein in similar manner to the examples provided herein.

Certain additional elements that may be needed for operation of certain embodiments have not been described or illustrated as they are assumed to be within the purview of those of ordinary skill in the art. Moreover, certain embodiments may be free of, may lack and/or may function without any element that is not specifically disclosed herein.

Although various embodiments and examples have been presented, this was for the purpose of describing, but not limiting, the invention. Various modifications and enhancements will become apparent to those of ordinary skill in the art and are within the scope of the invention, which is defined by the appended claims.

What is claimed:

1. A filter housing configured for use with a protective mask or other personal protective equipment, said filter housing comprising:

a base;

a top;

a sidewall connecting the top and the base;

a void configured to house a filter medium and/or filter medium cannister;

an inlet including an inlet opening for receiving ambient gas into the filter housing;

an outlet including an outlet opening for discharging gas from the filter housing to the protective mask or other personal protective equipment and an interface for removably securing the filter housing to the protective mask or other personal protective equipment, the interface including a proximal end connected to the base and a distal end configured to seal the filter housing to the protective mask or other personal protective equipment;

wherein, the base includes a concave surface surrounding the outlet opening and the interface, the concave surface extending downward from the proximal end of the interface toward the distal end of the interface such that the concave surface at least partially envelops the interface, and wherein, a space between the void and the concave surface of the base is partitioned by a plurality of members connected at least partially to the base and the sidewall and defining a substantially planar surface facing the void.

2. The filter housing of claim 1, wherein the interface includes a stem surrounding the outlet opening and at least partially enveloped by the concave surface.

3. The filter housing of claim 2, wherein the stem includes a distal face disposed at the distal end of the interface, the distal face including a circumferential groove.

4. The filter housing of claim 3, wherein the circumferential groove is configured to provide a double seal when the filter housing is joined to the protective mask or other personal protective equipment.

5. The filter housing of claim 3, wherein the circumferential groove has a depth of approximately 0.5 mm to 1.0 mm.

6. The filter housing of claim 3, wherein the groove is recessed relative to a sealing face of the stem.

7. The filter housing of claim 1, wherein the sidewall is substantially cylindrical.

8. The filter housing of claim 1, wherein the members include a plurality of ribs that are formed integrally with the base.

9. The filter housing of claim 1, wherein the members include a plurality of ribs extending outward from the outlet opening and a circumferential support wall having a similar shape to that of the sidewall.

10. The filter housing of claim 9, wherein the plurality of ribs form a substantially flat platform for support of a filtering medium or a fines pad.

11. The filter housing of claim 9, further including an air-permeable fines pad that is configured to support a filtering medium and is fixed to the support wall.

12. The filter housing of claim 9, wherein the support wall is constructed of a series of ribbed features.

13. The filter housing of claim 1, wherein the members include a plurality of recesses and/or openings that allow gas to pass between channels defined by the members.

14. The filter housing of claim 1, further comprising a cannister containing the filtering medium, the cannister having a substantially planar bottom surface that is supported by the substantially planar surface defined by the plurality of members.

15. A filter housing configured for use with a protective mask or other personal protective equipment, said filter housing comprising:

a base;

a top;

a sidewall connecting the top and the base;

a void configured to house a filter medium and/or filter medium cannister;

an inlet including an inlet opening for receiving ambient gas into the filter housing;

an outlet including an outlet opening for discharging gas from the filter housing; to the protective mask or other personal protective equipment; and an interface for removably securing the filter housing to the protective mask or other personal protective equipment, the interface including a proximal end connected to the base and a distal end configured to seal the filter housing to the protective mask or other personal protective equipment;

wherein, the base includes a concave surface substantially surrounding the outlet opening and the interface, the concave surface extending downward from the proximal end of the interface toward the distal end of the interface such that the concave surface at least partially envelops the interface, and wherein the interface includes a stem surrounding the outlet opening and at least partially enveloped by the concave surface, the stem including a distal face disposed at the distal end of the interface, the distal face including a circumferential groove.

16. The filter housing of claim 15, wherein the circumferential groove is configured to provide a double seal when the filter housing is joined to the protective mask or other personal protective equipment.

17. The filter housing of claim 15, wherein the circumferential groove has a depth of approximately 0.5 mm to 1.0 mm.

18. The filter housing of claim 17, wherein a space between the void and the concave surface of the base is partitioned by a plurality of members connected at least partially to the base and/or the sidewall and edges of the plurality of members collectively defining a substantially planar surface facing the void.

19. The filter housing of claim 18, wherein the members include a plurality of ribs that are formed integrally with the base.

20. The filter housing of claim 18, wherein the members include a plurality of ribs extending outward from the outlet opening and an annular circumferential support wall having a similar shape to the sidewall, and spaced apart from and within the sidewall.

* * * * *